US006447361B1

(12) United States Patent
Akiyama

(10) Patent No.: US 6,447,361 B1
(45) Date of Patent: Sep. 10, 2002

(54) BALLOON-SHAPED STRUCTURE DRIVING APPARATUS AND DISCHARGE/SUCTION SELECTOR VALVE DEVICE USED FOR THE BALLOON-SHAPED STRUCTURE DRIVING APPARATUS

(75) Inventor: Mineo Akiyama, Chofu (JP)

(73) Assignee: Show Corporation Co., Ltd., Hiroshima (JP)

( * ) Notice: Subject to any disclaimer, the term of this patent is extended or adjusted under 35 U.S.C. 154(b) by 0 days.

(21) Appl. No.: 09/639,562

(22) Filed: Aug. 16, 2000

(30) Foreign Application Priority Data

Aug. 27, 1999 (JP) ..... 11-242230

(51) Int. Cl.[7] ..... A63H 3/06; F16D 31/02; F16D 31/00

(52) U.S. Cl. ..... 446/226; 446/224; 137/625.21; 60/412

(58) Field of Search ..... 446/220, 221, 446/222, 223, 224, 225, 226; 137/625.21, 624.13, 625.22; 40/406, 412, 414, 419, 477, 624; 417/502, 442; 60/412

(56) References Cited

U.S. PATENT DOCUMENTS 4,070,856 A * 1/1978 Litt ..... 137/625.21
4,271,620 A * 6/1981 Vicino et al. ..... 40/406
4,487,224 A * 12/1984 Parker ..... 137/565.35
4,759,737 A * 7/1988 Ferenczi ..... 446/183
4,765,079 A 8/1988 Takahashi
5,104,346 A * 4/1992 Smrt ..... 446/199
5,205,774 A * 4/1993 Smrt ..... 446/199
5,299,599 A * 4/1994 Farmer et al. ..... 137/625.21
5,335,436 A * 8/1994 Gurr ..... 40/412
6,142,181 A * 11/2000 Schumacher ..... 137/625.21
6,152,176 A * 11/2000 Lin ..... 137/625.21
6,253,402 B1 * 7/2001 Lin ..... 137/625.21
6,266,833 B1 * 7/2001 Lin ..... 137/625.21

FOREIGN PATENT DOCUMENTS

| | | |
|---|---|---|
| JP | 211918 | 3/1990 |
| JP | 261033 | 12/1990 |
| JP | 345387 | 7/1991 |
| JP | 345389 | 7/1991 |
| JP | 345390 | 7/1991 |
| JP | 3168794 | 7/1991 |

* cited by examiner

*Primary Examiner*—Jacob K. Ackun
*Assistant Examiner*—Faye Francis
(74) *Attorney, Agent, or Firm*—Baker Botts L.L.P.

(57) ABSTRACT

The present invention provides a balloon-shaped structure driving apparatus by which portions of a balloon-shaped structure can be caused to move easily and reliably and weight and cost can be reduced and a discharge/suction selector valve device. A rotating blade of the discharge/suction selector valve device is rotated to a suction operating position to connect an air outlet and an air flowing hole, to exhaust air from actuators toward a pump device, and to contract a bellows portion. At this time, the actuators pull acting portions of arm portions of a balloon robot main body, the balloon robot main body is bent at allowance portions which can be bent, and the arm portions are forcibly moved down.

5 Claims, 11 Drawing Sheets

BALLOON-SHAPED STRUCTURE DRIVING APPARATUS AND DISCHARGE/SUCTION SELECTOR VALVE DEVICE USED FOR THE BALLOON-SHAPED STRUCTURE DRIVING APPARATUS

BACKGROUND OF THE INVENTION

1. Field of the Invention

The present invention relates to a balloon-shaped structure driving apparatus used for driving a balloon-shaped structure, for example, such as a balloon robot and a discharge/suction selector valve device used for the balloon-shaped structure driving apparatus.

2. Description of the Related Art

Conventionally, a balloon-shaped structure in a shape of a character or an animal is produced and used for a purpose of advertisement, ornament, or the like.

An outside shape portion of the balloon-shaped structure is formed by sewing by using cloth, a film, and the like, the structure is inflated by sending air through an air hole into the structure by using an air blower and the like, and a predetermined outside shape is maintained by continuing air blowing.

A balloon-shaped structure in a shape of a doll is proposed in which arm portions are movable so as to cause hands of the doll to wave to enhance advertising effect, for example.

In order to move a portion of the balloon-shaped structure, one end of rope is fixed to a predetermined portion of an inside of the structure, the other end of the rope is connected to a driving apparatus such as a motor and an air cylinder, and the rope is pulled. In this case, the driving apparatus is disposed outside the structure and the rope is pulled into the driving apparatus through the inside of the balloon-shaped structure.

However, in the above prior-art balloon-shaped structure, because the rope is pulled while air is injected from the air blower to push an outer wall face outward, large pulling force is required. Moreover, unnecessary movement such as movement of the whole structure is caused.

Therefore, a method in which a structure resistant to high pressure is disposed inside the balloon-shaped structure and the rope is routed through a pulley or the like by using the structure as a pedestal is devised. In this case, however, it is necessary to make the structure tough or to provide a complicated mechanism to stably obtain desirable movement.

As a result, manufacturing cost is increased especially in a case of a large balloon-shaped structure and weight of the structure is increased such that the structure is difficult to move.

SUMMARY OF THE INVENTION

Therefore, it is an object of the present invention to provide a balloon-shaped structure driving apparatus by which portions of a balloon-shaped structure can be caused to move easily and reliably and weight and cost can be reduced and a discharge/suction selector valve device used for the balloon-shaped structure driving apparatus.

To achieve the above object, according to the invention described in claim 1, there is provided a balloon-shaped structure driving apparatus for a balloon-shaped structure having a portion which can be bent, wherein the balloon-shaped structure driving apparatus comprises a displacing member displaced by supplying or drawing of gas, a gas discharge/suction device for supplying or drawing the gas to and from the displacing member, a discharge/suction selector valve device for switching between supplying and drawing of the gas to and from the gas discharge/suction device, and a control portion for controlling at least the gas discharge/suction device and the discharge/suction selector valve device and a portion of the balloon-shaped structure is displaced by supplying the gas from the gas discharge/suction device or drawing the gas into the gas discharge/suction device by switching of the discharge/suction selector valve device to displace the displacing member and causing the displacement to act on a predetermined portion.

To achieve the above object, according to the invention described in claim 2, there is provided a balloon-shaped structure driving apparatus for bending a balloon-shaped structure at a portion which can be bent, an outline of the balloon-shaped structure being formed by filling pressurized gas into an inside and the balloon-shaped structure having the portion which can be bent in a state in which the outline is formed, wherein the balloon-shaped structure driving apparatus comprises a pump device having a discharge hole for discharging gas and a suction hole for drawing the gas, an actuator disposed inside the balloon-shaped structure and having a body portion which can be expanded and contracted and which is expanded and contracted when the gas flows into and out of the actuator through a flowing hole to change volume of the actuator, and a discharge/suction selector valve device having a valve main body including a partition which can be displaced inside the valve main body, a first flowing hole connected to the discharge hole and for flowing in of the gas, a second flowing hole connected to the suction hole and for flowing out of the gas, a third flowing hole connected to the flowing hole and for flowing in and out of the gas, and a fourth flowing hole which is open for flowing in and out of the gas being provided to predetermined portions of the valve main body, the partition being disposed in any one of a first disposition state for connecting the first flowing hole and the second flowing hole, a second disposition state for connecting the first flowing hole and the third flowing hole and for connecting the second flowing hole and the fourth flowing hole, and a third disposition state for connecting the second flowing hole and the third flowing hole and for connecting the first flowing hole and the fourth flowing hole, a movable portion of the actuator is connected to a predetermined acting portion inside the balloon-shaped structure, and the predetermined portion which can be bent is bent when movement of the movable portion is transmitted to the acting portion.

To achieve the above object, according to the invention described in claim 3, there is provided a balloon-shaped structure driving apparatus according to claim 2, wherein pressure of the pressurized gas is controlled such that the pressure is reduced by a predetermined value when the actuator is operating and the predetermined portion which can be bent is bent.

To achieve the above object, according to the invention described in claim 4, there is provided a balloon-shaped structure driving apparatus according to claim 2 or 3, wherein the discharge hole and the first flowing hole, the suction hole and the second flowing hole, and the flowing hole of the actuator and the third flowing hole are respectively connected by pipes having flexibility.

To achieve the above object, according to the invention described in claim 5, there is provided a balloon-shaped structure driving apparatus according to any one of claims 2 to 4, wherein the actuator is supported by an inside structure which is provided inside the balloon-shaped structure, an outline of which is formed by filling pressurized gas into an inside of the inside structure, and predetermined strength of which is maintained at a hull portion.

To achieve the above object, according to the invention described in claim 6, there is provided a discharge/suction selector valve device used for a balloon-shaped structure driving apparatus for bending a balloon-shaped structure at a portion which can be bent by an actuator using gas pressure as driving force, an outline of the balloon- shaped structure being formed by filling pressurized gas into an inside, the balloon-shaped structure having the portion which can be bent in a state in which the outline is formed, and the discharge/suction selector valve device being connected to the actuator and switching between flowing in and out of the gas for driving, wherein the discharge/suction selector valve device has a valve main body including a partition which can be displaced inside the valve main body, a first flowing hole into which the gas flows from a pump device, a second flowing hole from which the gas flows out toward the pump device, a third flowing hole connected to the actuator, and a fourth flowing hole which is open are provided to predetermined portions of the valve main body, the partition is disposed in any one of a first disposition state for connecting the first flowing hole and the second flowing hole, a second disposition state for connecting the first flowing hole and the third flowing hole and for connecting the second flowing hole and the fourth flowing hole, and a third disposition state for connecting the second flowing hole and the third flowing hole and for connecting the first flowing hole and the fourth flowing hole.

To achieve the above object, according to the invention described in claim 7, there is provided a discharge/suction selector valve device according to claim 6 and used for the balloon-shaped structure driving apparatus, wherein the valve body has a substantially circular sectional shape, the first, second, and third flowing holes are provided to a wall portion of the valve body, and the partition is brought into any one of the first, second, and third disposition states by rotating about a substantially central shaft of the valve main body.

DETAILED DESCRIPTION OF THE PREFERRED EMBODIMENTS

The embodiments of the present invention will be described below in detail by reference to the drawings.

First Embodiment

Figure 1:
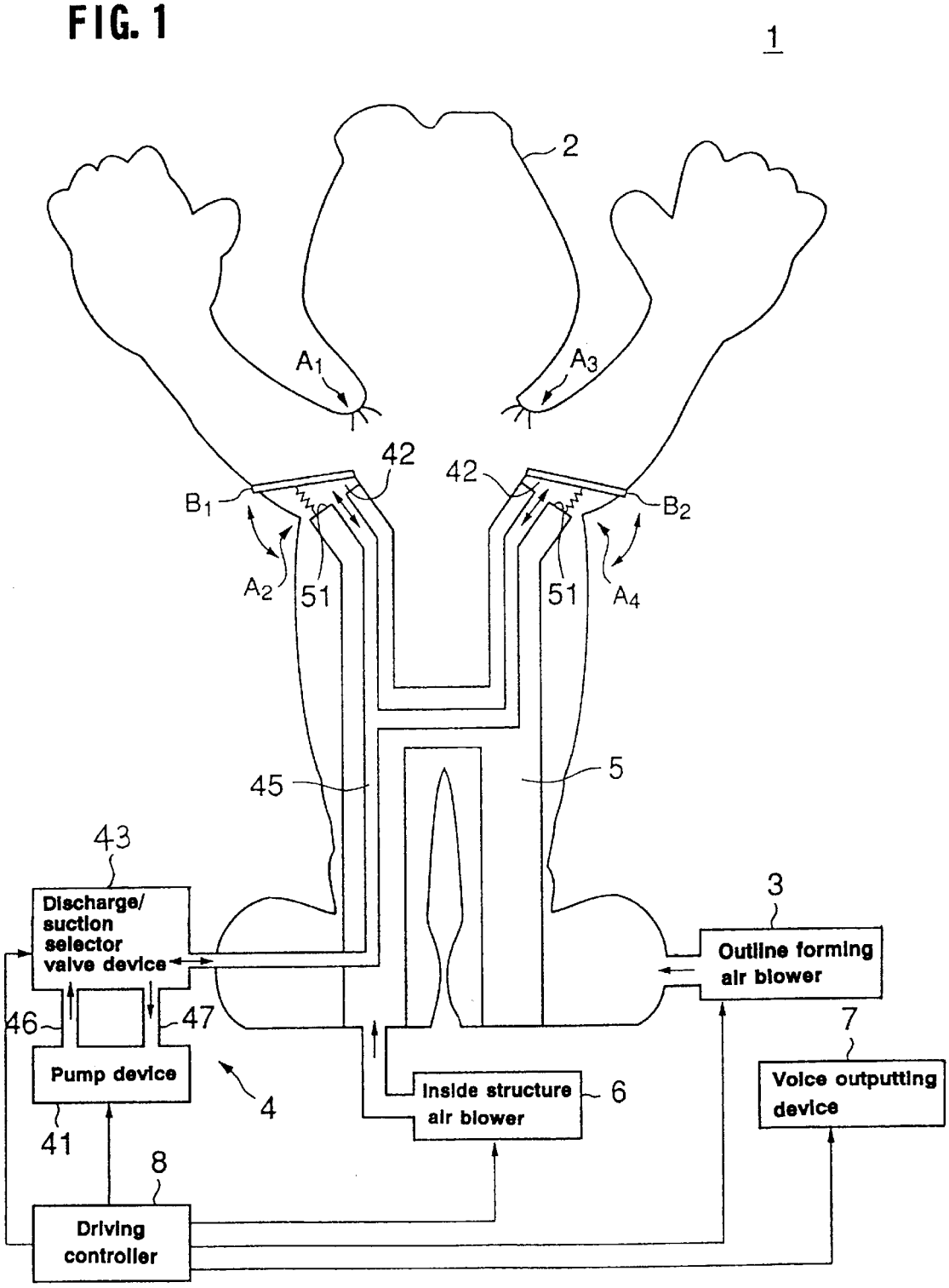
FIG. 1 is a schematic diagram showing a schematic structure of a balloon robot as a balloon-shaped structure according to the first embodiment of the present invention.
Figure 2:
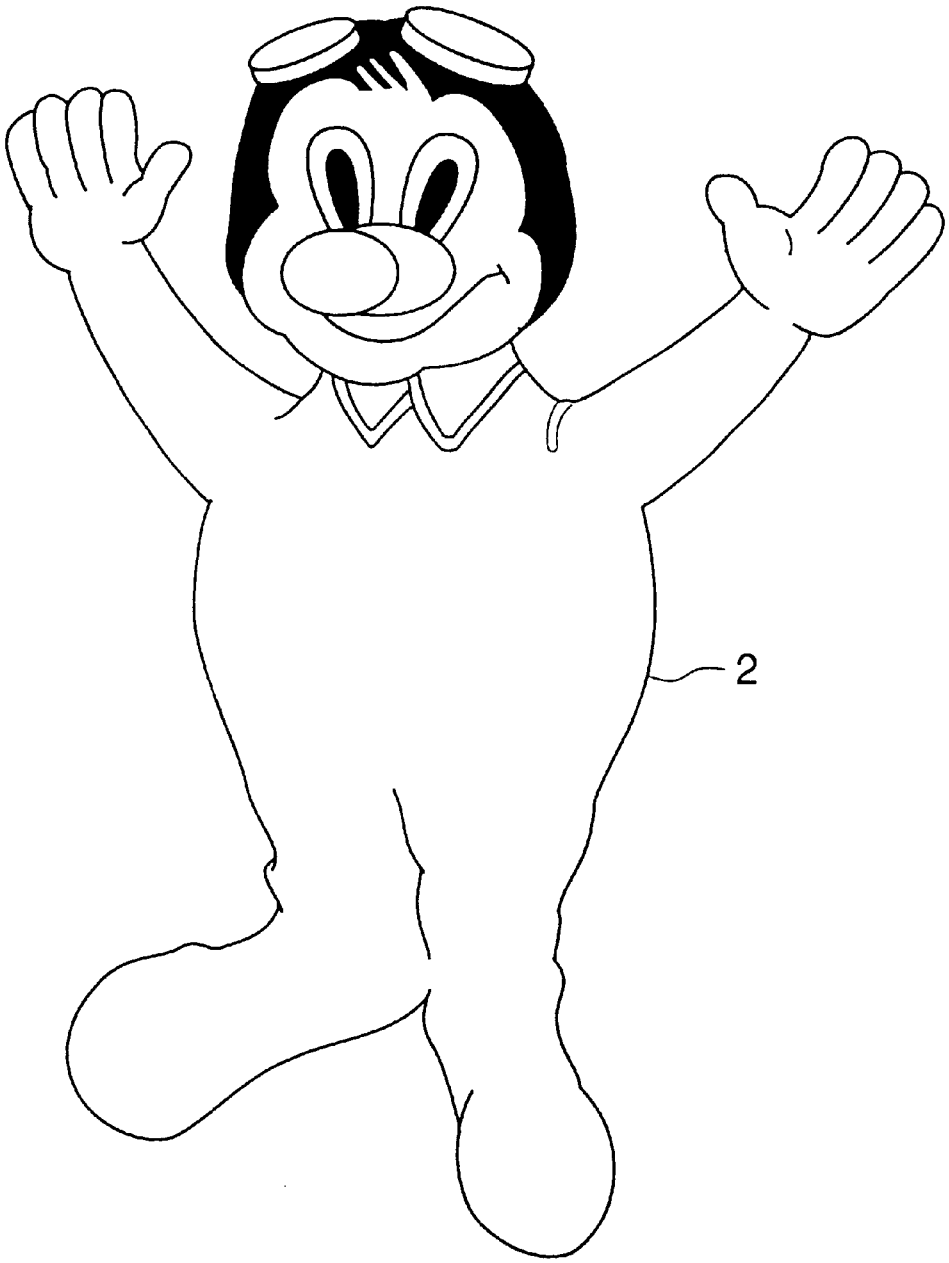
FIG. 2 is a perspective view of an outward appearance of the balloon robot.
Figure 3:
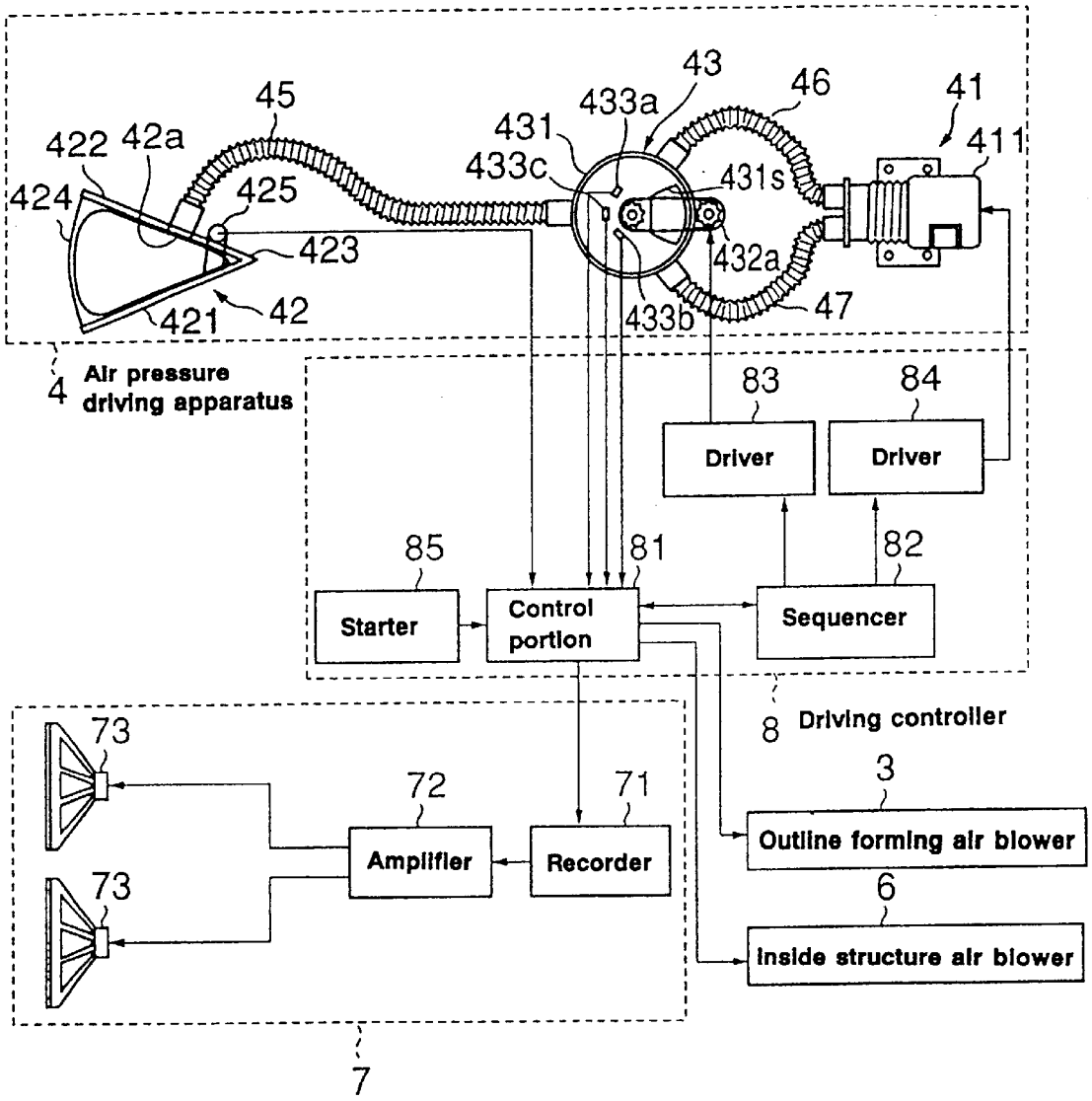
FIG. 3 shows a structure of an essential portion of the balloon robot.
Figure 4:
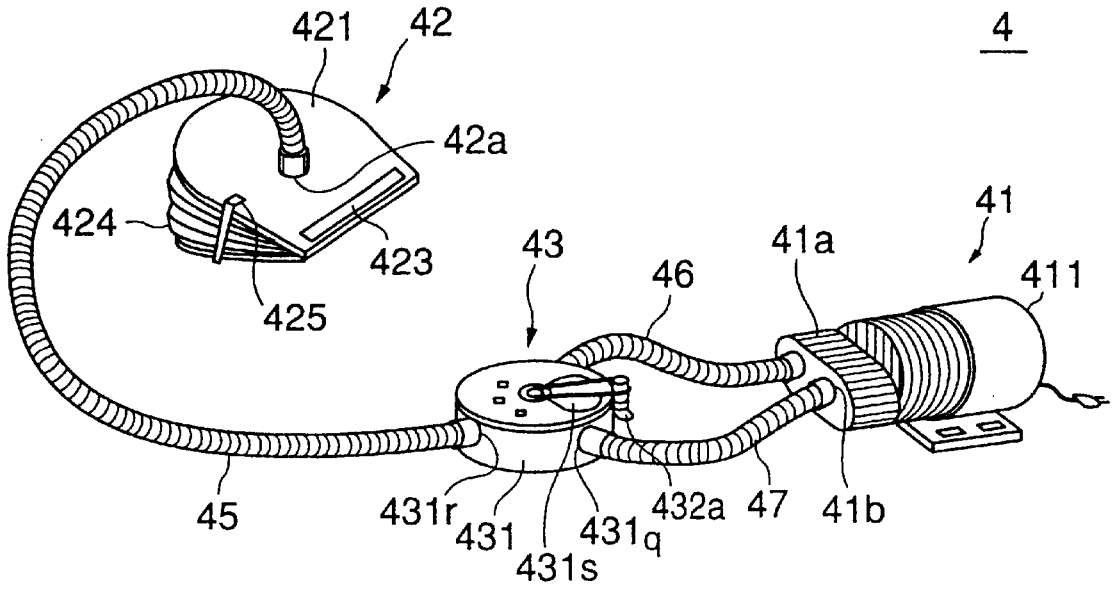
FIG. 4 is a perspective view of a structure of an air pressure driving apparatus as a gas pressure driving apparatus forming the balloon robot.
Figure 5:
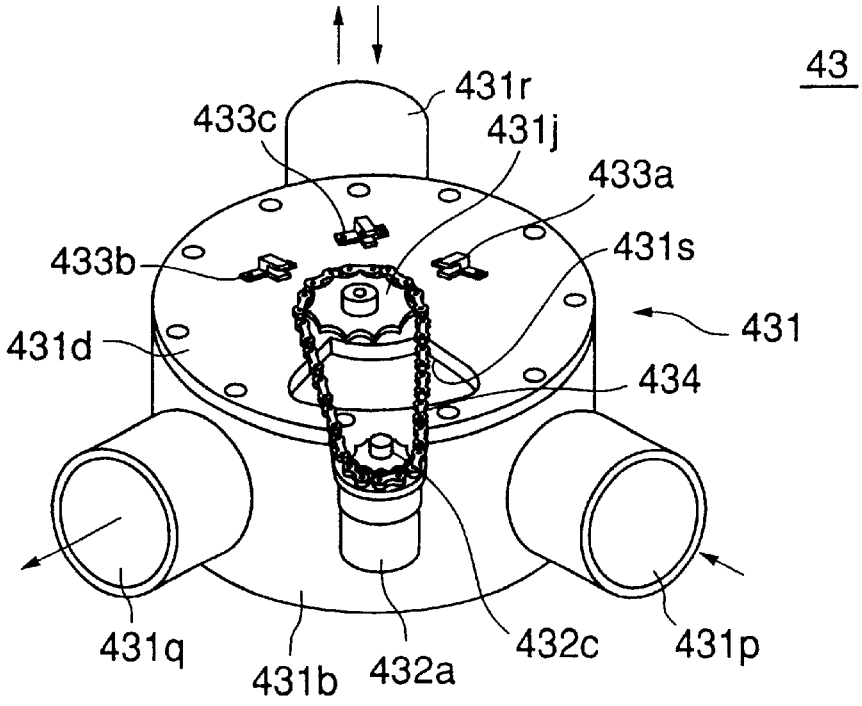
FIG. 5 is a perspective view of a structure of a discharge/suction selector valve device forming the air pressure driving apparatus.
Figure 6:
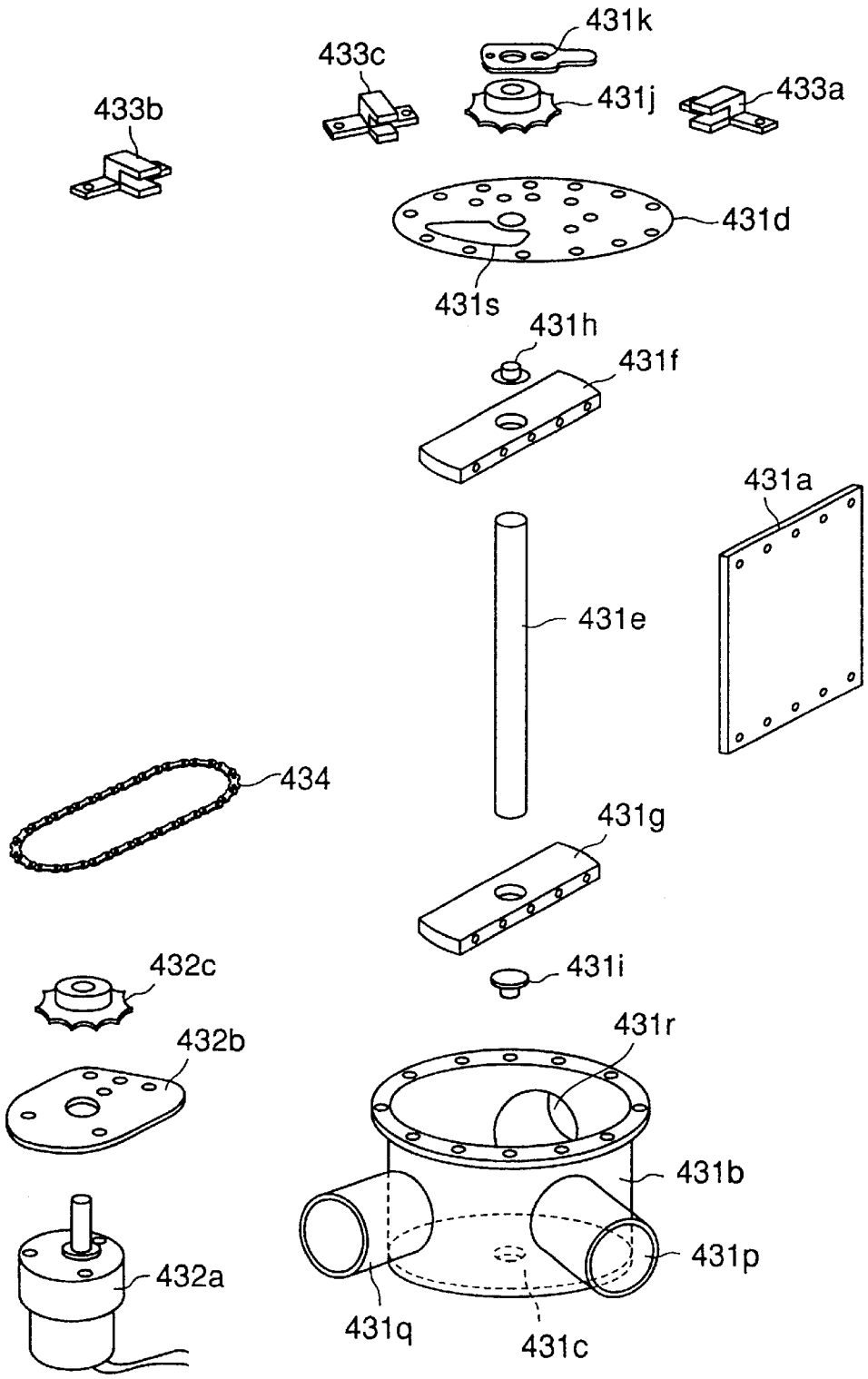
FIG. 6 is an exploded perspective view of a structure of the discharge/suction selector valve device.
Figure 7A:
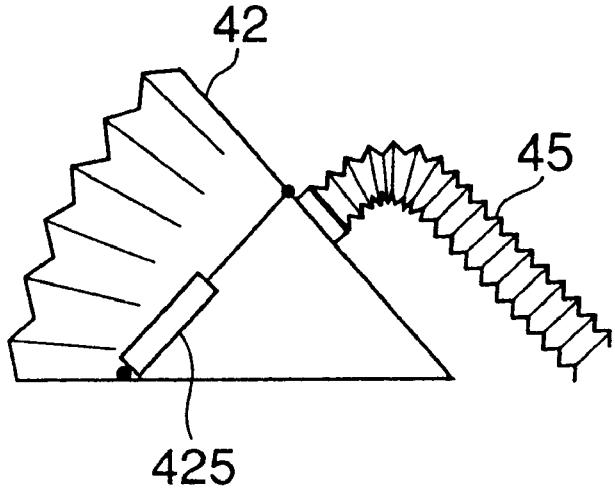
FIGS. 7(*a*) and 7(*b*) are explanatory views for explaining operation of an actuator forming the air pressure driving apparatus.
Figure 7B:
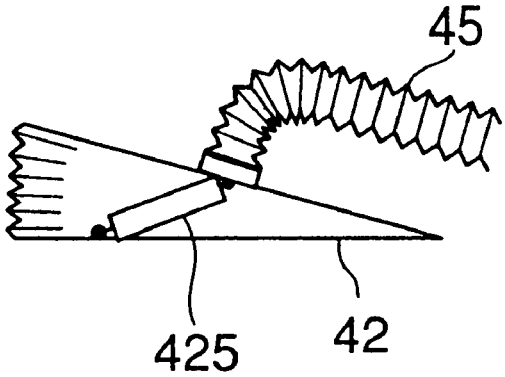
Figure 8A:
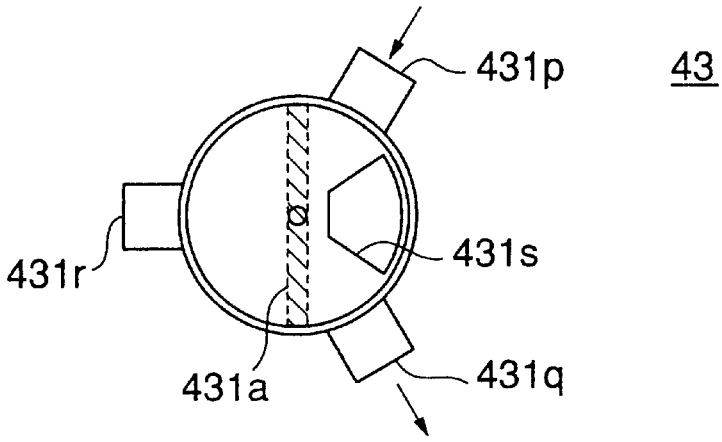
FIGS. 8(*a*) to 8(*c*) are explanatory views for explaining operation of the discharge/suction selector valve device.
Figure 8B:
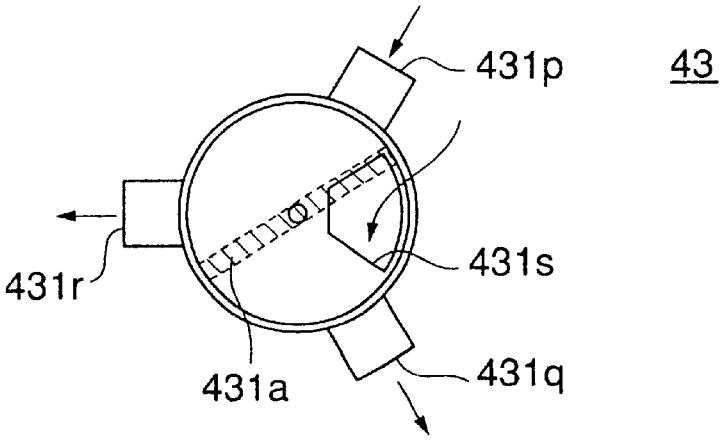
Figure 8C:
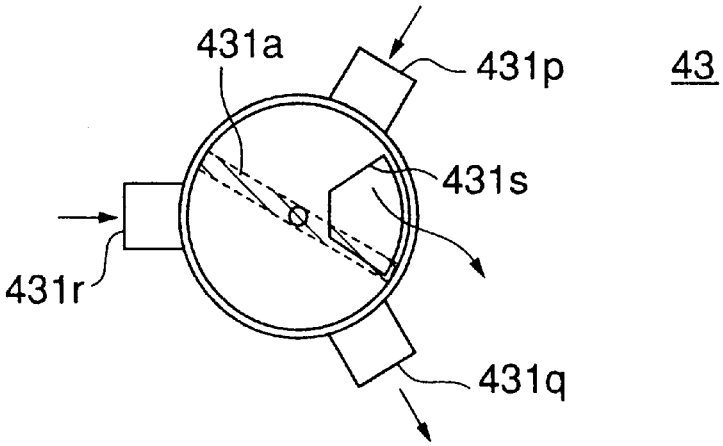
Figure 9A:
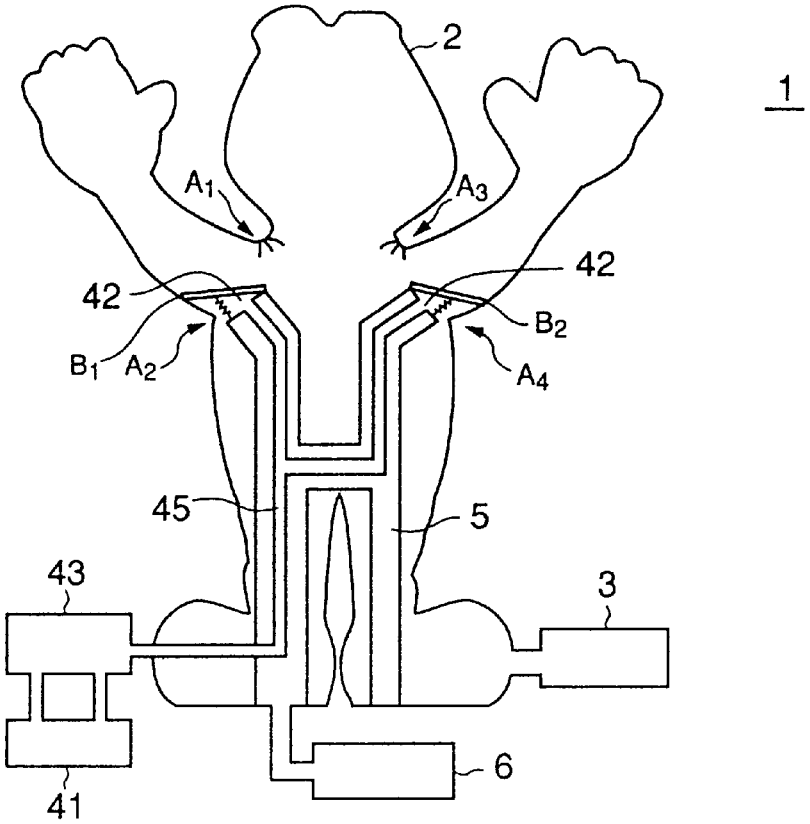
FIGS. 9(*a*) and 9(*b*) are explanatory views for explaining operation of the balloon robot.
Figure 9B:
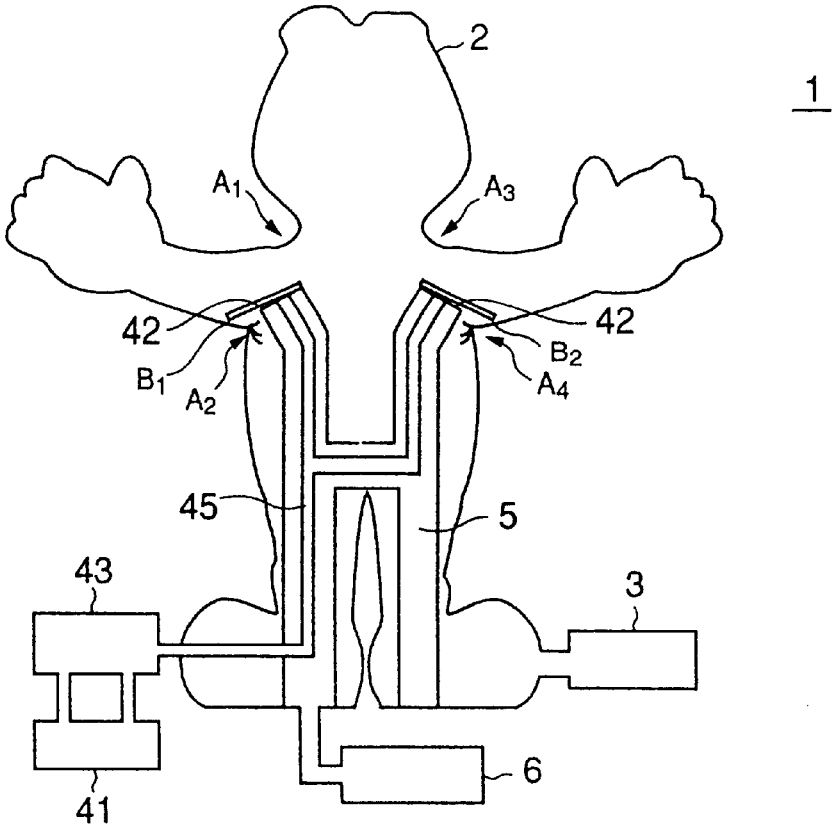

FIG. 1 is a schematic diagram showing a schematic structure of a balloon robot as a balloon-shaped structure according to the first embodiment of the present invention. FIG. 2 is a perspective view of an outward appearance of a balloon robot main body. FIG. 3 shows a structure of an essential portion of the balloon robot. FIG. 4 is a perspective view of a structure of an air pressure driving apparatus as a gas pressure driving apparatus forming the balloon robot. FIG. 5 is a perspective view of a structure of a discharge/suction selector valve device forming the air pressure driving apparatus. FIG. 6 is an exploded perspective view of a structure of the discharge/suction selector valve device. FIGS. 7(*a*) and 7(*b*) are explanatory views for explaining operation of an actuator forming the air pressure driving apparatus. FIGS. 8(*a*) to 8(*c*) are explanatory views for explaining operation of the discharge/suction selector valve device. FIGS. 9(*a*) and 9(*b*) are explanatory views for explaining operation of the balloon robot.

As shown in FIGS. 1 to 3, an outline of the balloon robot 1 according to the first embodiment is formed by filling pressurized air into an inside of the balloon robot 1 and the balloon robot 1 has a balloon robot main body 2 formed by sewing cloth, a film, or the like, for example, for forming an outside shape portion, an outline forming air blower 3 for sending pressurized air into the inside of the balloon robot main body 2, an air pressure driving apparatus 4 for bending predetermined portions of the balloon robot main body 2, an inside structure 5 which is provided inside the balloon robot main body 2, an outline of which is formed by filling pressurized gas at relatively high pressure into an inside of the inside structure 5, in which predetermined strength is maintained at a hull portion, and in which actuators are fixed to and supported on predetermined placing faces 51 in vicinities of acting portions of the balloon robot main body 2, an inside structure air blower 6 for sending pressurized air into the inside of the inside structure 5, a voice outputting device 7 for outputting a predetermined voice message or the like in synchronization with the bending movement of the balloon robot main body 2, for example, and a driving controller 8 for controlling respective constituting portions such as the outline forming air blower 3 and the air pressure driving apparatus 4.

The balloon robot main body 2 has allowance portions A1 to A4 where the main body 2 can be bent in a state in which the outline of the main body 2 is formed. When the balloon robot main body 2 is in a pose in which both arm portions of the main body 2 are held up as shown in FIG. 1, folds are formed at the allowance portions A1 and A3 of the balloon robot main body 2 and the allowance portions A1 and A3 are folded.

As shown in FIGS. 1 and 3 to 5, the air pressure driving apparatus 4 has a pump device (gas discharge/suction device) 41 including a discharge hole 41*a* for discharging air and a suction hole 41*b* for drawing air, actuators (displacing members) 42, 42 volume of which changes due to air flowing into and out of the actuators 42, 42 through ventilating holes 42*a* such that the actuators 42, 42 expand and contract and which include movable plates respectively disposed in the vicinities of the predetermined acting portions B1 and B2 of arm portions of the balloon robot main body 2 to stretch or slacken the acting portions B1 and B2 connected to the movable plates, and a discharge/suction selector valve device 43 provided on air supply and exhaust paths between the pump device 41 and the respective actuators 42 for switching between supplying air to the respective actuators 42 and exhausting air from the actuators 42.

In each the actuator 42, a fixed plate 421 fixed to the placing face 51 of the inside structure 5 and the movable plate (movable portion) 422 connected to the acting portion B1 or B2 are connected by a hinge 423 in a form of a bivalve such that the fixed plate 421 and the movable plate 422 can open and close, a body is formed of a bellows portion 424 that can expand and contract in the above opening/closing direction between the fixed plate 421 and the movable plate 422, and a ventilating hole 42*a* to which a flexible pipe 45 is connected and through which air is supplied to and exhausted from an inside of the actuator 42 is provided to a center portion of the movable plate 422, for example.

A displacement sensor 425 for sensing an opening amount between the fixed plate 421 and the movable plate 422 is mounted to each the actuator 42.

As the displacement sensor 425, a direct-acting potentiometer is used, for example, and a displacement detecting signal whose voltage changes in response to the opening amount is sent to the driving controller 8.

Movement of the movable plates 422 of the actuators 42 act on the predetermined acting portions B1 and B2 inside the balloon robot main body 2 and the balloon robot main body 2 is bent at the predetermined allowance portions A1 to A4 which can be bent.

The discharge/suction selector valve device 43 has a substantially cylindrical valve main body 431 in which a rotatable rotating blade (partition) 431*a* is mounted, a blade driving motor 432*a* for rotating the rotating blade 431*a*, and position sensors 433*a*, 433*b*, and 433*c* for sensing a rotating position of the rotating blade 431*a*.

The valve main body 431 has a substantially cylindrical frame body 431*b*, a bottom plate 431*c*, and a top plate 431*d*. To a wall portion of the frame body 431*b*, an air inlet 431*p* connected to the discharge hole 41*a* through a flexible pipe 46, an air outlet 431*q* connected to the suction hole 41*b* through a flexible pipe 47, and an air flowing hole 431*r* connected to the ventilating hole 42*a* through a flexible pipe 45 are provided at substantially regular intervals in a circumferential direction such that respective axial directions of the air inlet 431*p*, the air outlet 431*q*, and the air flowing hole 431*r* are positioned at approximately 120° with respect to each other and an open air flowing hole 431*s* is provided to the top plate 431*d*.

As shown in FIG. 6, the rotating blade 431*a* is mounted to side faces of an upper blade fixing bar 431*f* and a lower blade fixing bar 431*g* respectively fixed to an upper end and a lower end of a driving shaft 431*e* which will be a rotary shaft. In this state, the rotating blade 431*a* is rotatably housed in the frame body 431*b* through oil-less (Oiles) 431*h* and 431*i*. In a sate in which the rotating blade 431*a* is housed and the top plate 431*d* is put on the frame body 431*b*, a blade-side sprocket 431*j* is mounted by using the oil-less (Oiles) 431*h* and then, a sensor dog 431*k* is mounted.

Further, the blade driving motor 432*a* is mounted between the air inlet 431*p* and the air outlet 431*q* on the wall portion of the frame body 431*b* and a motor-side sprocket 432*c* is mounted to a shaft of the blade driving motor 432*a* through a motor mounting hardware 432*b*. A driving chain 434 is looped over the motor-side sprocket 432*c* and the blade-side sprocket 431*j* and the rotating blade 431*a* rotates as the blade driving motor 432*a* rotates.

Here, the rotating blade 431*a* is positioned in any one of the following rotating positions (see FIG. 8): an operation stop position (first disposition state) in which the rotating blade 431*a* is positioned such that a normal direction of one face of the rotating blade 431*a* is substantially aligned with an axial direction of the air flowing hole 431*r* to connect the air inlet 431*p* and the air outlet 431*q*, to separate the air flowing hole 431*r* and the air inlet 431*p*, and the air outlet 431*q* and the air flowing hole 431*s*, and to intercept flowing of air between the actuator 42 and the pump device 41; a discharge operating position (second disposition state) in which the rotating blade 431*a* is positioned such that the normal direction of the rotating blade 431*a* is substantially aligned with an axial direction of the air outlet 431*q* to connect the air inlet 431*p* and the air flowing hole 431*r*, to separate the air flowing hole 431*r* and the air inlet 431*p*, and the air outlet 431*q* and the air flowing hole 431*s*, and to allow supply of air to the actuators 42; and a suction operating position (third disposition state) in which the rotating blade 431*a* is positioned such that the normal direction of the rotating blade 431*a* is substantially aligned with an axial direction of the air inlet 431*p* to connect the air outlet 431*q* and the air flowing hole 431*r*, to separate the air inlet 431*p* and the air flowing hole 431*s*, and to allow exhausting of air from the actuators 42.

The operation stop position, the discharge operating position, and the suction operating position are respectively sensed by the position sensors 433*a*, 433*b*, and 433*c*.

The voice outputting device 7 has a recorder 71 on which a predetermined voice message or the like is recorded and which outputs a voice signal according to control of the driving controller 8, an amplifier 72 for amplifying the voice signal output from the recorder 71 and providing the signal to speakers, and the speakers 73, 73.

As shown in FIGS. 1 and 3, the driving controller 8 has a control portion 81 having a CPU and controlling respective portions according to a predetermined control program based on sensing signals from the respective sensors, a sequencer 82 for controlling drivers which will be described later according to a predetermined driver control program under control of the control portion 81, drivers 83 and 84 for respectively driving the blade driving motor 432*a* and a motor 411 for the pump device 41, and a starter 85 for starting activation.

When the actuators 42 are actuated to bend the balloon robot main body 2 at the predetermined allowance portions A1 to A4 which can be bent, the control portion 81 controls the outline forming air blower 3 such that pressure of the pressurized gas is reduced by a predetermined value.

Next, operation will be described.

First, the outline forming air blower 3 and the inside structure air blower 6 respectively send pressurized air into the balloon robot main body 2 and the inside structure 5 to inflate them and to form predetermined outlines under the control of the control portion 81.

At the same time, the control portion 81 causes the drivers 83 and 84 to operate through the sequencer 82 based on the position sensing signals sent from the position sensors 433*a*, 433*b*, and 433*c*, thereby driving the blade driving motor 432*a*, rotating the rotating blade 431*a* to the discharge operating position, and driving the pump device 41.

As shown in FIG. 8(*b*), because the rotating blade 431*a* is positioned in the discharge operating position, the air inlet 431*p* communicates with the air flowing hole 431*r* and air discharged from the pump device 41 is supplied to the actuators 42. At this time, air flows through the air flowing hole 431*s* into the valve main body 431 and is drawn through the air outlet 431*q* into the pump device 41.

In each the actuator 42, the bellows portion 424 is expanded when sufficient air is supplied into the actuator 42. When the control portion 81 senses that the bellows portion 424 is sufficiently expanded as shown in FIG. 7(*a*) based on a displacement sensing signal sent from the displacement sensor 425 and corresponding to the opening amount, i.e., volume of the actuator 42, the control portion 81 rotates the rotating blade 431*a* to the operation stop position.

At this time, as shown in FIG. 8(*a*), because the air flowing between the actuator 42 and the pump device 41 is intercepted and the air inlet 431*p* communicates with the air outlet 431*q*, air discharged from the discharge hole 41*a* of the pump device 41 returns to the suction hole 41*b*. As a result, the volume of the actuator 42 is maintained and the movable plate 422 stops.

At this time, the balloon robot main body 2 is inflated due to pressure of air sent from the outline forming air blower 3 and makes a pose with both hands held as shown in FIG. 9(*a*).

Then, the control portion 81 controls the respective portions according to a predetermined movement producing program for causing the balloon robot main body 2 to move. For example, the control portion 81 causes the driver 83 to operate again through the sequencer 82, thereby driving the blade driving motor 432*a* and rotating the rotating blade 431*a* to the suction operating position.

Because the rotating blade 431*a* is in the suction operating position as shown in FIG. 8(*c*), the air outlet 431*q* communicates with the air flowing hole 431*r* and air is exhausted from the actuator 42 toward the pump device 41. At this time, air that has flowed in through the air inlet 431*p* is released to an outside of the valve main body 431 through the air flowing hole 431*s*.

In each the actuator 42, when air is drawn from the inside of the actuator 42, the bellows portion 424 contracts as shown in FIG. 7(*b*), the movable plate 422 moves toward the fixed plate 421 to pull the acting portion B1 or B2 of the arm portion of the balloon robot main body 2, the balloon robot main body 2 is bent at the allowance portions A1 to A4 which can be bent, and the arm portion is forcibly moved down as shown in FIG. 9(*b*).

At this time, the allowance portions A1 and A3 in folded states of the balloon robot main body 2 are stretched and the allowance portions A2 and A4 in stretched states are folded on the contrary.

The control portion 81 controls the outline forming air blower 3 such that pressure of the pressurized gas is reduced by a predetermined value during the pulling operation by the actuators 42.

Then, the control portion 81 controls again such that the acting portions B1 and B2 are slackened to repeat the above upward and downward movement of the arm portions.

On the other hand, during the upward and downward movement of the arm portion, for example, the control portion 81 controls the voice outputting device 7 to cause the voice outputting device 7 to output the predetermined voice message or the like corresponding to the movement of the balloon robot main body 2.

As described above, according to the first embodiment, because the actuators 42 have strong operating force though they are small and lightweight and because the predetermined allowance portions A1 to A4 which can be bent are bent when the actuators 42 pull the predetermined acting portions B1 and B2 partially, for example, it is possible to easily and reliably cause the balloon robot main body 2 to move partially and stably without causing the whole movement of the main body 2 and it is possible to cause the main body 2 to smoothly carry out a series of preprogrammed and desired movement, for example.

By fixing each the actuator 42 onto the placing face 51 of the tough inside structure 5, even the large actuator 42 can be reliably supported on the placing face 51 to operate stably. Moreover, because each the actuator 42 can be easily disposed in the vicinity of the acting portion, it is possible to accurately and reliably displace only the portion that needs to be displaced directly by the actuator without routing the rope or the like, for example.

This contributes to weight reduction of the whole and suppresses manufacturing cost.

Because the control portion 81 controls the outline forming air blower 3 such that pressure of the pressurized gas by the predetermined value when the balloon robot main body 2 is bent at the predetermined allowance portions A1 to A4 which can be bent, it is possible to easily cause the balloon robot main body 2 to move with smaller force.

Because the discharge/suction selector valve device 43 is connected to the pump device 41 and the actuators 42 through the flexible pipes 45, 46, and 47, the position where the discharge/suction selector valve device 43 is disposed is not limited by the positions of the acting portions B1 and B2.

Figure 10A:
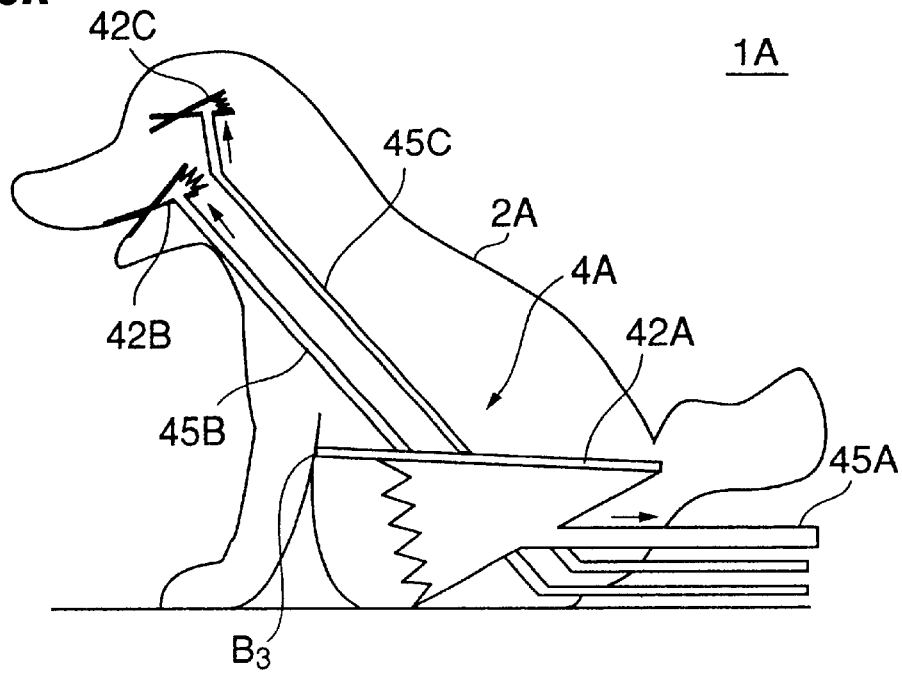
FIGS. 10(*a*) and 10(*b*) are schematic diagrams showing a schematic structure of an essential portion of a balloon robot as a balloon-shaped structure according to second embodiment of the invention, wherein FIG. 10(*a*) shows a state in which each actuator is expanded and FIG. 10(*b*) shows a state in which each the actuator is contracted.
Figure 10B:
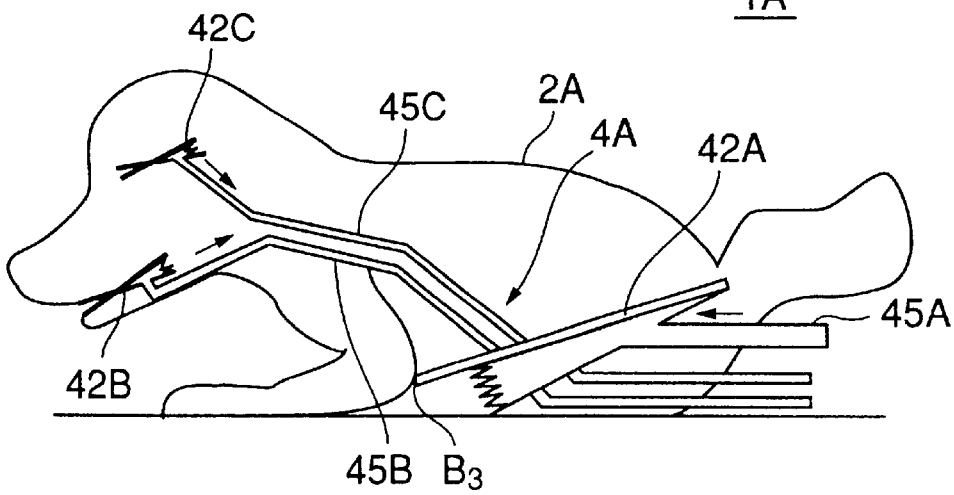
Figure 11A:
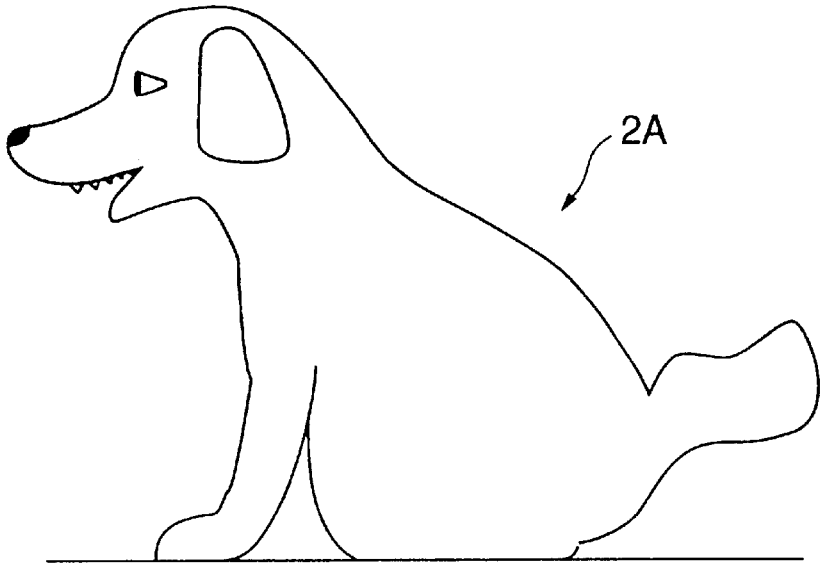
FIGS. 11(*a*) and 11(*b*) show an outward appearance of the balloon robot may body, wherein FIG. 11(*a*) shows a state in which each the actuator is expanded and FIG. 11(*b*) shows a state in which each the actuator is contracted.
Figure 11B:
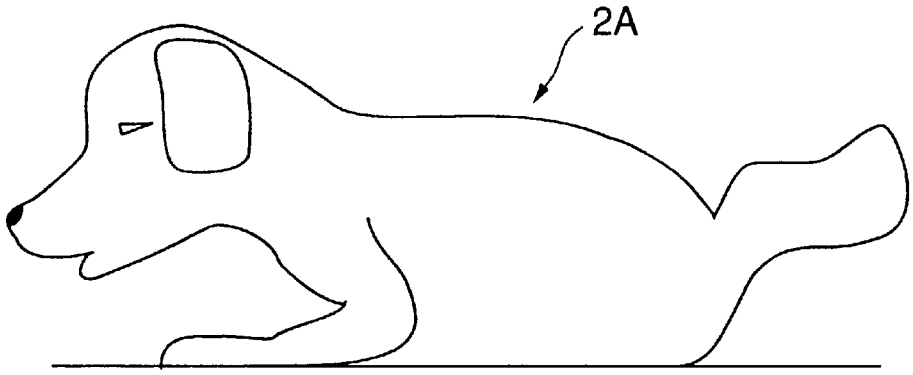

Second Embodiment FIGS. 10(*a*) and 10(*b*) are schematic diagrams showing a schematic structure of an essential portion of a balloon robot as a balloon-shaped structure according to the second embodiment of the invention, wherein FIG. 10(*a*) shows a state in which each actuator is expanded and FIG. 10(*b*) shows a state in which each the actuator is contracted. FIGS. 11(*a*) and 11(*b*) show an outward appearance of the balloon robot, wherein FIG. 11(*a*) shows a state in which each the actuator is expanded and FIG. 11(*b*) shows a state in which each the actuator is contracted.

The second embodiment is different from the above first embodiment in that the actuators are directly mounted to an inner face of a hull forming a balloon robot main body 2A without using an inside structure.

As shown in FIGS. 10(*a*) to 11(*b*), a balloon robot 1A according to the second embodiment has the balloon robot main body 2A in a shape of a dog, an air pressure driving apparatus 4A for bending predetermined portions of the balloon robot main body 2A, an outline forming air blower, a voice outputting device, and a driving controller (not shown).

The air pressure driving apparatus 4A has a middle-sized actuator 42A for causing a whole body to stand and flatten by moving up and down an acting portion B3 at forelegs, a small-sized actuator 42B for opening and closing a mouth, and a super-small actuator 42*c* for opening and closing eyes, for example.

Corresponding flexible pipes 45A, 45B, and 45C are respectively connected to the respective actuators 42A, 42B, and 42C such that air flows into and out of the actuators and the actuators 42A, 42B, and 42C are expanded and contracted independently.

For example, as shown in FIGS. 10(*a*) and 11(*a*), by simultaneously causing air to flow into the actuators 42A, 42B, and 42C to expand the actuators, a state in which the balloon robot main body 2A stands with its forelegs stretched and its mouth and eyes open.

As shown in FIGS. 10(*b*) and 11(*b*), by simultaneously drawing air from the actuators 42A, 42B, and 42C to contract the actuators, the balloon robot main body 2A flattens and closes its mouth and eyes.

As described above, according to the second embodiment, substantially the same effects as those in the above first embodiment can be obtained. Moreover, movement including fine movement such as opening and closing of the eyes and mouth and large movement of the whole body, for example, can be obtained smoothly and reliably without necessity of the inside structure. By combining the above movement, it is possible to easily obtain complicated movement.

Although the embodiments of the invention have been described above in detail, a concrete structure is not limited to the embodiments.

For example, although the case in which the arm portions of the balloon robot main body 2 are moved up and down has been described as an example in the above first embodiment, the invention is not limited to this and movement of shaking a head, bending an upper part of the body, or the like may be incorporated.

Not necessarily one set of air inlet, air outlet, and air flowing hole is provided to the valve main body 431, but a plurality of sets may be provided such that the valve main body 431 is connected to a plurality of actuators.

The shape of the actuator is not limited to the bivalve shape but may be a cylindrical shape.

The balloon robot main body 2 is formed such that the main body 2 can be bent by folding the portions A1 and A3, for example. It is also possible to use material with higher flexibility for the portions A1 and A3 than for other portions.

Figure 12A:
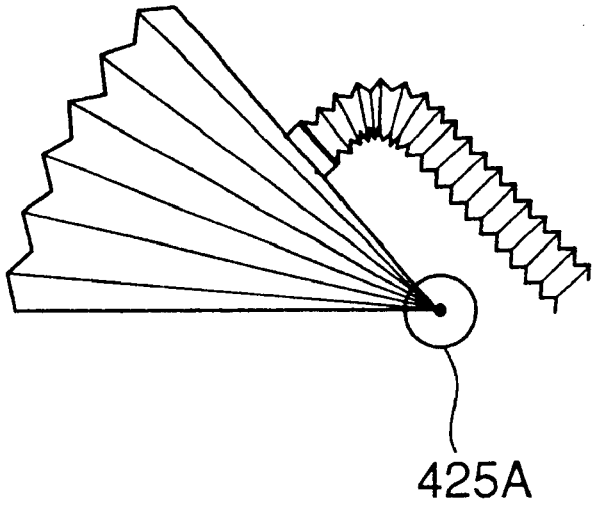
FIGS. 12(*a*) and 12(*b*) are explanatory views for explaining operation of an actuator of a balloon robot according to a modification of the first embodiment of the invention.
Figure 12B:
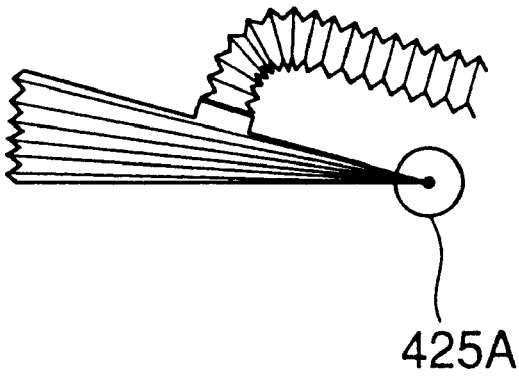

It is also possible to use a rotary potentiometer 425A as the displacement sensor to produce displacement detecting signals according to opening amounts of a expanded state shown in FIG. 12(*a*) and a contracted state shown in FIG. 12(*b*), for example.

It is also possible to separately provide pump devices for discharge and suction.

As described above, according to the invention described in claim 1, the movable portion of the displacing member is connected to the predetermined portion inside the balloon-shaped structure, displacement of the displacing member is transmitted to the portion, and the portion which can be bent is bent by partially pulling or pushing the portion, for example. Therefore, it is possible to easily and reliably cause the balloon-shaped structure to carry out partial movement or complicated movement formed by combining the partial movement.

By disposing the displacing member in the vicinity of the above predetermined portion, for example, it is possible to accurately, reliably, and efficiently displace the portion to be displaced directly by the displacing member without routing the rope or the like and it is possible to suppress unnecessary movement.

This contributes to weight reduction of the whole and suppresses manufacturing cost.

According to the invention described in claim 2, the movable portion of the actuator is connected to the predetermined acting portion inside the balloon-shaped structure and movement is transmitted to the acting portion. Thus, the predetermined portion which can be bent is bent by partially pulling or pushing the acting portion, for example. Therefore, it is possible to easily and reliably cause the balloon-shaped structure to carry out partial movement or complicated movement formed by combining the partial movement.

By disposing the actuator in the vicinity of the above predetermined acting portion, for example, it is possible to accurately, reliably, and efficiently displace the portion to be displaced directly by the actuator without routing the rope or the like and it is possible to suppress unnecessary movement.

According to the invention described in claim 3, the pressure of the pressurized gas is controlled such that the pressure is reduced by the predetermined value so as to bend the balloon-shaped structure at the predetermined portion which can be bent. Therefore, it is possible to easily cause the balloon-shaped structure to move with smaller force.

According to the invention described in claim 4, the discharge/suction selector valve device is connected to the pump device and the actuator by the pipes having flexibility. Therefore, the disposing position of the discharge/selector valve device is not limited by a position of an object of operation.

According to the invention described in claim 5, the actuator can be supported by the inside structure and disposed in the vicinity of the acting portion inside the balloon-shaped structure, for example, in a stable state. Therefore, it is possible to reliably and accurately cause the balloon-shaped structure to be bent.

According to the invention described in claim 6, by selecting the disposition state of the partition in the valve main body, it is possible to cause the gas to flow from the first flowing hole toward the third flowing hole, to cause the gas to flow from the third flowing hole to the second flowing hole, or to separate the third flowing hole from the first and second flowing holes. Therefore, by connecting the actuator using the gas pressure as driving force to the third flowing hole, it is possible to freely switch between the discharge operation of the gas to the actuator and the suction operation of the gas from the actuator.

According to the invention described in claim 7, by rotating the partition about the substantially central shaft of the valve main body, the partition is brought into the first to third disposition states. Therefore, by connecting the actuator using the gas pressure as driving force to the third flowing hole, it is possible to reliably switch between the discharge operation and suction operation of the gas at high speed.

What is claimed is:

1. A balloon driving apparatus for bending a balloon at folded portions, where an outline of said balloon is formed by filling said balloon with a pressurized gas inside said balloon, said balloon driving apparatus comprising:

a pump device having a gas discharge hole and a gas suction hole;

an actuator configured to be disposed inside the balloon and supported by an inside structure of said balloon for filling said balloon with a pressurized gas, said pressurized gas forming an outline of said balloon by filling said balloon with said pressurized gas, said actuator having movable portions which are expanded or contracted when said pressurized gas flows into or out of said actuator through a flowing hole to change a gas volume of said actuator; and a discharge and suction selector valve device having a valve main body comprising:

a partition which is displaced inside said valve main body;

a first flowing hole connected by a flexible pipe to said suction hole for flowing in said pressurized gas;

a second flowing hole connected by a flexible pipe to said suction hole for flowing out said pressurized gas;

a third flowing hole connected by a flexible pipe to said hole for flowing-in and out said pressurized gas; and a fourth flowing hole which is open for flowing in and out said pressurized gas being provided to given positions of said main valve body, said partition being disposed in any one of a first disposition state for connecting said first flowing hole and said second flowing hole, a second disposition state for connecting said first flowing hole and said third flowing hole and connecting said second flowing hole and said fourth flowing hole, and a third disposition state for connecting said second flowing hole and said third flowing hole and connecting said first flowing hole and said fourth flowing hole; said movable portions of said actuator being connected to said folded portions inside said balloon such that when said movable portions are moved, such movements are transmitted to the folded portions.

2. The balloon driving apparatus of claim 1 further comprising a pressurized gas controller, wherein said pressurized gas controller controls a pressure of said pressurized gas, wherein said pressure is reduced by a predetermined value when actuator is operating and when a predetermined portion of said balloon is bent.

3. The balloon driving apparatus of claim 2, wherein said discharge hole and said first flowing hole, said suction hole and said second flowing hole, and said flowing hole of said actuator and said third flowing hole are respectively connected by pipes having flexibility.

4. The balloon driving apparatus of claim 1, wherein said discharge hole and said first flowing hole, said suction hole and said second flowing hole, and said flowing hole of said actuator and said third flowing hole are respectively connected by pipes having flexibility.

5. The balloon driving apparatus of claims 1, 2, or 4, wherein said actuator is supported by said inside structure of said balloon.

* * * * *